US006161773A

United States Patent [19]

Camplin et al.

[11] Patent Number: 6,161,773

[45] Date of Patent: Dec. 19, 2000

[54] FUEL INJECTOR NOZZLE WITH GUIDE TO CHECK CLEARANCE PASSAGE PROVIDING INJECTION RATE SHAPING

[75] Inventors: Fred A. Camplin; Thomas G. Ausman, both of Peoria, Ill.

[73] Assignee: Caterpillar Inc., Peoria, Ill.

[21] Appl. No.: 08/251,545

[22] Filed: May 31, 1994

[51] Int. Cl.[7] ..... F02M 47/02

[52] U.S. Cl. ..... 239/88; 239/533.4

[58] Field of Search ..... 239/88, 90–92, 239/95, 96, 533.7, 533.4, 533.3

[56] References Cited

U.S. PATENT DOCUMENTS

| | | | |
|---|---|---|---|
| 2,793,077 | 5/1957 | Bovard | 239/88 |
| 3,006,556 | 10/1961 | Shade et al. | 239/88 |
| 3,368,761 | 2/1968 | Pelizzoni | 239/533.4 |
| 4,219,154 | 8/1980 | Luscomb | 239/91 |
| 5,020,500 | 6/1991 | Kelly | 123/467 |
| 5,191,867 | 3/1993 | Glassey | 123/446 |
| 5,287,838 | 2/1994 | Wells | 123/467 |

FOREIGN PATENT DOCUMENTS

| | | | |
|---|---|---|---|
| 58-18552 | 2/1983 | Japan | 239/88 |
| 566692 | 1/1945 | United Kingdom | 239/92 |

*Primary Examiner*—Andres Kashnikow
*Assistant Examiner*—Lesley D. Morris
*Attorney, Agent, or Firm*—Dykema Gossett

[57] ABSTRACT

A fuel injector nozzle has a housing defining a blind bore with at least one fuel injection spray orifice defined at a bottom portion of a spray tip and a guide passage defined at a top portion of the bore. An injection chamber of the bore is disposed between the orifice and the guide passage. A fuel injection passage intersects the guide passage. A needle check is slidably disposed in the blind bore for movement between a first position and a second position. In the first position, a seat portion of the check is disposed in the bore against the bottom portion of the tip while a guide portion of the check together with the guide passage define a first flow area restricting fluid flow therethrough. In the second position, the seat portion of the check is spaced from the bottom portion of the tip, and the guide portion and guide passage define a second flow area larger than the first flow area and less restrictive of flow therepast.

4 Claims, 3 Drawing Sheets

FUEL INJECTOR NOZZLE WITH GUIDE TO CHECK CLEARANCE PASSAGE PROVIDING INJECTION RATE SHAPING

TECHNICAL FIELD

The present invention relates generally to fuel injectors, and more particularly to high pressure fuel injector nozzles.

BACKGROUND ART

Examples of high pressure fuel injection systems are shown in U.S. Pat. No. 5,020,500 issued to Kelly on Jun. 4, 1991, and U.S. Pat. No. 5,191,867 issued to Glassey et al. on Mar. 9, 1993. Engines equipped with high pressure fuel injection systems have an optimal volumetric injection rate. For diesel-cycle engines, this optimal injection rate typically has a gradual rise, a period of stabilization, followed by a sharp drop. Means of producing this characteristic profile are commonly referred to as rate shaping means or devices because they are used to shape the volumetric rate of fuel injection into an engine combustion chamber. The gradual rise followed by a sharp drop in fuel injection has the specific benefits of minimizing both particulate emissions and noise from combustion.

Fuel injector nozzles typically include a housing with an elongated cavity or void along a first axis. The cavity has a first end portion or injection chamber and a second end portion or spring chamber with a guide passage disposed therebetween. At least one injection orifice fluidly connects the injection chamber of the cavity with an atmosphere (e.g., engine combustion chamber) external to the fuel injector. A needle check is slidably disposed within the cavity for translation between a first position in which a seat portion of the needle check seats against a first end portion of the cavity in the injection chamber, thereby blocking the passage of fuel through the injection orifice, and a second position wherein the needle is spaced from the first end portion and does not block the injection orifice.

The fuel injector of Glassey et al. is configured largely as described above. A guide passage of the cavity is in slidable contact with the guide portion of the needle check. Pressurized fuel directed to the injection chamber of the cavity overcomes a biasing spring to move the check away from the first end portion. Glassey does not teach the provision of any rate shaping means in the nozzle other than the small amount of rate shaping inherently provided by a hydraulically-actuated injector.

The fuel injector nozzle disclosed by Kelly is generally similar to that of Glassey et al., except that it includes a second guide passage near the first end portion with which the needle check is in slidable contact near its seat portion. This second guide passage is disposed between a location where high pressure fuel is introduced to the injection chamber and the first end portion of the cavity with the injection orifice. For fuel to reach the injection orifice, it must first seep through a very restrictive flow area between the check and the second guide passage to develop sufficient pressure between the first end portion of the cavity and the check so that the force against the needle check can overcome a resisting spring. Once the check is partially lifted to a predetermined height, an enlarged passage with a much larger flow area between the needle and the second guide passage is opened, providing more direct fluid communication between the source of high pressure fuel and the first end portion of the cavity. At that point of operation, the volumetric rate of fuel passing through the orifices increases. It is the selective variance of the rate of fuel reaching the orifices which is characterized as rate shaping. However, the specific configuration of the injection chamber and guide passages disclosed by Kelly, particularly the second guide passage, is relatively difficult to fabricate with the degree of precision necessary with tooling suited for high volume production.

It is desired to provide a fuel injector nozzle having rate shaping characteristics provided by initially restricting the flow of fuel between a guide passage of a check cavity and a guide portion of the check until the check reaches a predetermined lift height avoiding the use of a second guide passage near the first end portion.

DISCLOSURE OF THE INVENTION

In one aspect of the present invention, a fuel injector nozzle is disclosed comprising a nozzle housing and a needle check. The nozzle housing defines a blind bore with at least one orifice at a bottom portion of the bore and a guide passage at a top portion of the bore. An injection chamber portion of the bore is disposed between the orifice and the guide passage. A fuel injection passage intersects the guide passage. The needle check is slidably disposed in the blind bore for movement between a first position and a second position. In the first position, a seat portion of the check is disposed against the bottom portion of the bore. Also in the first position, a guide portion of the check together with the guide passage defines a first flow area restricting fluid flow therethrough. In the second position, the seat portion of the check is spaced from the bottom portion of the bore, and the guide portion and guide passage define a second fluid flow area larger than the first fluid flow area and less restrictive of fluid flow therepast.

The present invention discloses a fuel injector nozzle providing multistage fuel injection rate shaping without a guide passage proximate to the bottom portion of the bore. A flow area between a needle check and a guide passage substantially controls the volumetric rate of fluid passing to an injection chamber and is shiftable between two values. A shift between a first flow area and a second flow area occurs with axial displacement of the check. When the check is in a first position, the first flow area restricts flow reaching at least one spray orifice from the discharge passage in an initial stage of injection. When the check is in the second position, the second flow area is larger, allowing fuel at significantly higher pressures to reach the orifice, thereby producing a greater volumetric flow rate through the nozzle. The guide passage is disposed at an end portion of a nozzle housing opposite the spray orifice, making it easier to fabricate the nozzle in general and the guide passage specifically.

The nozzle housing may also be provided with a restrictive orifice or passage connecting the discharge passage with the injection chamber.

BEST MODE FOR CARRYING OUT THE INVENTION

Figure 1:
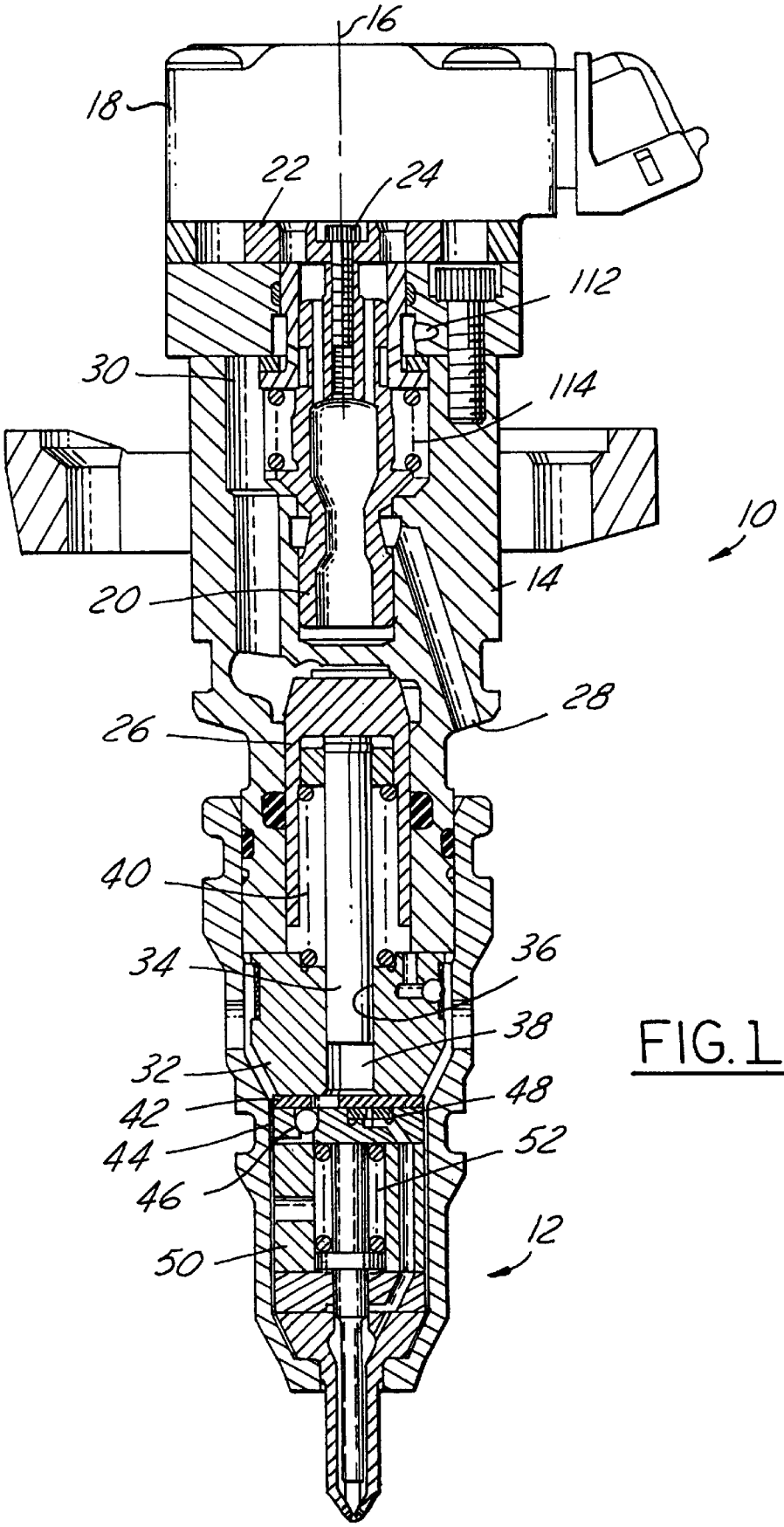
FIG. 1 is a diagrammatic cross sectional view of one embodiment of a fuel injector nozzle installed on an exemplary fuel injector.

An exemplary fuel injector such as a hydraulically-actuated electronically-controlled unit fuel injector 10, hereinafter referred to as a HEUI fuel injector is shown in FIG. 1. Although shown here as a unitized, or unit fuel injector, the injector 10 could alternatively be of a modular construction with, for example, a nozzle assembly 12 separate from a fuel pressurization device or source of pressurized fuel.

The fuel injector 10 of FIG. 1 has an injector body 14 with a central longitudinal axis 16. An electrical actuator 18 such as a solenoid is mounted over an upper end portion of the injector body 14. A poppet valve 20 is slidably disposed in the body 14 for operable movement between first and second positions. The poppet valve 20 is fixed to a movable armature 22 of the solenoid actuator 18 by an intermediate threaded fastener 24. The solenoid actuator 18 operably displaces the poppet valve 20 between the first position and the second position in response to electronic signals received by the solenoid 18 from an electronic control module (not shown).

An intensifier piston 26 is slidably disposed in the body 14 for axial displacement therein. A hydraulic fluid inlet passage 28 communicates highly pressurized hydraulic fluid to the poppet valve 20 from a high pressure manifold (not shown). Internal hydraulic fluid passages 30 communicate hydraulic fluid from the poppet valve 20 to the intensifier piston 26 when the poppet valve is at its second (upward) position. When the poppet valve 20 is in the first (downward) position, the poppet valve 20 blocks communication of hydraulic actuating fluid from the inlet passage 28 to the intensifier piston 26.

A lower end portion of the injector body 14 abuts a barrel assembly 32. A reciprocal fuel pump plunger 34 extends from the piston 26 downward into an axial bore 36 of the barrel assembly 32. A fuel pumping chamber 38 is defined by a portion of the barrel bore 36 at one end portion of the plunger 34. A plunger return spring 40 biases the plunger 34 and the intensifier piston 26 upward according to FIGS. 1 and 2.

Beneath the barrel assembly 32 is the nozzle assembly 12. An intermediate spacer plate 42 defines a fuel inlet aperture therethrough. A stop 44 is disposed beneath the intermediate plate 42. A first valve 46, such as a ball type inlet check valve, in the stop 44 is in fluid communication with the aperture of the intermediate plate 42 and allows one-way fluid flow therepast into the pumping chamber 38. A second or reverse flow check valve 48 in the stop 44 permits fluid flow therepast from the pumping chamber 38, but blocks the return of fluid or combustion gas to the pumping chamber 38. These features are more clearly seen in FIG. 2.

A cylindrical sleeve 50 is disposed beneath the check stop 44. The sleeve 50 defines an axial spring chamber 52 therethrough, a separate discharge passage 54 or fuel injection passage, and an exhaust port 56 passing from an outside of the sleeve to the spring chamber 52. The fuel injection passage 54 is in one-way fluid communication with the second check valve 48.

A guide washer 58 abuts the sleeve 50 opposite the stop 44. The guide washer 58 has an axial guide bore or passage 60 therethrough, open on both ends. A fuel injection passage guide washer portion 62 is in direct fluid communication with the sleeve portion 54 at the sleeve 50, and has a groove 63 serving as a passage portion of the fuel injection passage portion 62 intersecting the guide passage 60 on a side of the guide washer opposite the side of the guide washer 58 abutting sleeve 50.

A fuel injection nozzle spray tip 64 abuts the guide washer 58 opposite the sleeve 50. A shim 65 may optionally be installed between the tip 64 and the guide washer 58. An axially extending blind bore 66 extends from a top portion of the tip 64 adjacent the guide washer 58 to a bottom portion 69 of the bore in an end portion 68 of the tip 64. One or more fuel injection spray orifices 70 are defined through an end portion 68 of the tip 64 which also defines a bottom portion 69 of the blind bore 66. A restrictive passage 72 communicates fluid from the discharge passage guide washer portion 62 to a cardioid shaped section 74 of an injection chamber 76 of the blind bore 66. A portion of the blind bore 66 between the cardioid section 74 and the upper edge of the tip 64 provides an extension of the guide passage 60. The spring chamber 52, the guide passage 60, and the blind bore 66 can together be characterized as a single elongated check cavity 78 extending along the axis 16. A first end portion of the elongated cavity 78 is coincident with the bottom portion 69 of the bore 66. A second end portion 82 of the check cavity 78 is at the stop 44.

A needle check 84 is slidably disposed in the check cavity 78 for axial translation between a first or closed position A and a second or open position B. The check 84 is shown in the first position in solid lines both FIGS. 1 and 2 with a seat portion 86 of the check 84 disposed against the bottom portion 69 of the bore 66. The check is shown in the second position B in phantom lines in FIG. 2. The needle check 84 has a guide portion 88 sized to provide a predetermined minimum annular clearance with the guide passage 60. The seat portion 86 of the needle check 84 defines a surface area of engagement with the bottom portion 69 of the tip 64, an axial projection of which is smaller than a cross-sectional area of the guide portion 88. The seat portion 86 of the needle check 84 blocks communication of fuel from the injection chamber 76 to the fuel injection spray orifices 70 when the check 84 is disposed in the first or seated position A. A spring seat 90 is larger in diameter than the guide portion 88, extending radially from the axis 16 almost the full diameter of the spring chamber 52.

Figure 2:
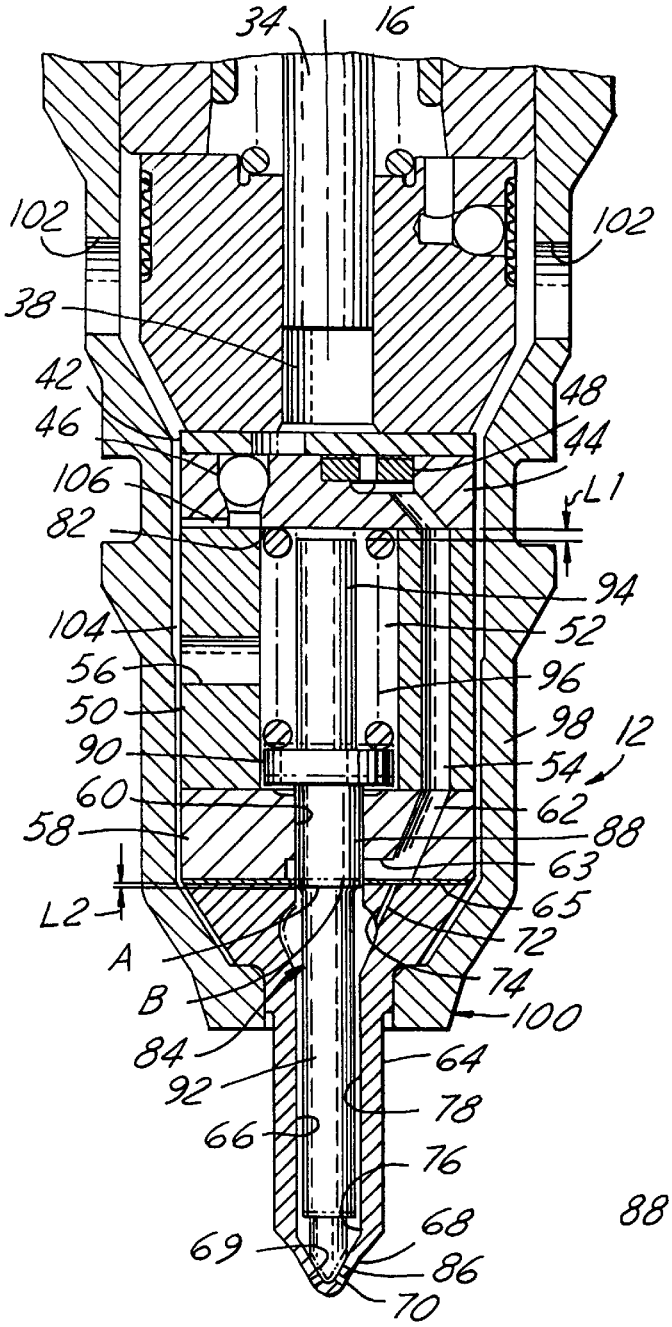
FIG. 2 is a diagrammatic enlarged cross-sectional view of the fuel injector nozzle of FIG. 1.

An intermediate portion 92 of the needle check 84 between the guide portion 88 and the seat portion 86 is of a diameter smaller than that of the guide portion 88. A travel limit portion 94 of the needle check 84 axially extends from the spring seat 90 opposite the guide portion 88. In the first position A, the travel limit portion 94 is spaced a distance of L1 from the stop 44, limiting total available travel of the needle check 84 to a lift or displacement of L1. For example, L1 may be approximately 0.3 to 0.4 mm (0.012 to 0.016 inches). A helical compression spring 96 is disposed in the spring chamber 52 between the spring seat 90 and the check stop 44. The spring biases the seat portion 86 of the check 84 against the end portion 68 of the tip 64. With the needle check 84 in the first position, the guide portion 88 of the check 84 overlaps the portion of the guide passage 60 in the needle tip 64 by an amount equal to L2 which, for example, may be approximately 0.050 millimeters (0.002 inches). As shown in FIGS. 1 and 2, L2 is limited by the axial length of the guide portion 88 of the needle check 84. This can be varied as necessary with the thickness of the shim 65. L2 is alternatively controlled by varying a length of the guide passage 60 below the upper edge of the needle tip 64.

A casing 98 such as an internally-threaded nut encases a lower portion of the injector body 14, the barrel assembly 32, the intermediate plate 42, the check stop 44, the sleeve 50, the guide washer 58, and the tip 64 to maintain them in an operating relationship with respect to one another. Together the stop 44, the sleeve 50, the guide washer 58, the tip 64, and the casing 98 may be characterized as a nozzle housing 100.

The casing 98 has one or more fuel inlet openings 102 passing therethrough preferably approximately normal to the axis 16. The casing 98 defines an annular fuel passage 104 between itself and the barrel assembly 32 and the stop 44 fluidly connected to the fuel inlet openings 102. An edge filter passage 106 in the stop 44 extends from the annular fuel passage 104 to the first inlet check valve 46.

Figure 3:
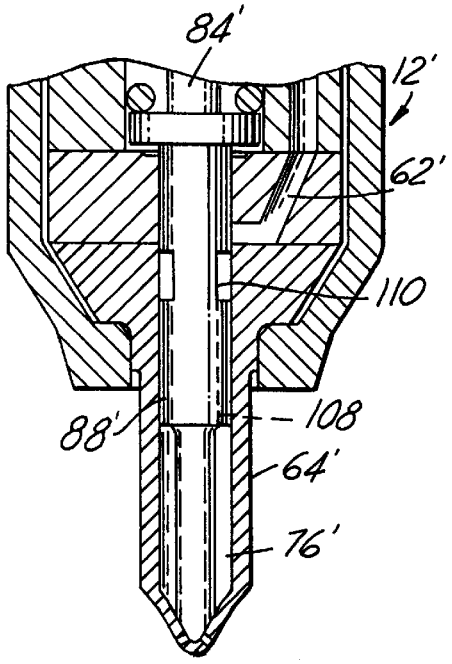
FIG. 3 is a diagrammatic view similar to FIG. 2 but showing a second embodiment of a fuel injector nozzle.
Figure 4:
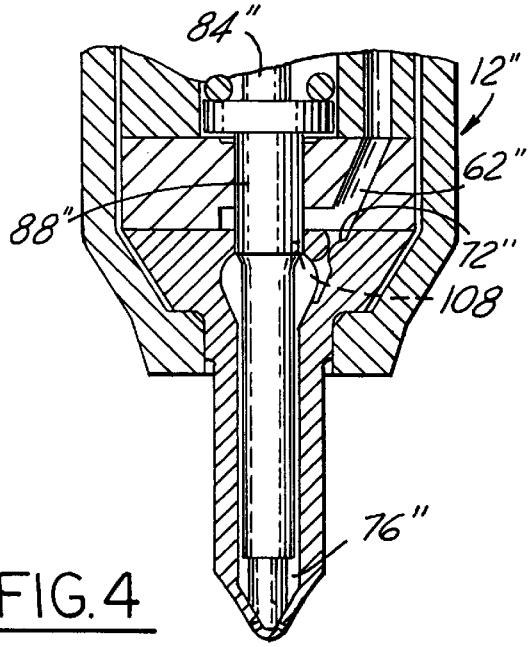
FIG. 4 is a diagrammatic view similar to FIG. 2 but showing a third embodiment of a fuel injector nozzle.

Two alternative embodiments of the subject fuel injector nozzle are shown in FIGS. 3 and 4. Both alternative checks 84' and 84" provide relatively longer guide portions 88' and 88" respectively without requiring an increase in overall length of the checks. This is accomplished by providing a flow channel 108 in each of the checks 84' and 84" which fluidly connect the discharge passages 62' and 62" with the injection chambers 76' and 76". The channel 108 of the check 84' in FIG. 3 is additionally supplemented by a notch 110 which opens to the fuel injection passage 62' in the second position B. The tip 64' of FIG. 3 is optionally shown without a restrictive passage 72 between the fuel injection passage 62' and the injection chamber 76'. The tip 64" of FIG. 4 is optionally shown with a restrictive passage 72".

INDUSTRIAL APPLICABILITY

In operation, fluid enters the fluid inlet passage 28 at a variable pressure, for example about 23 MPa (3335 psi). In the first (downward) position, the poppet valve 20 blocks the further advance of the pressurized fluid into the injector body 14. At the first position, the poppet valve 20 communicates the internal hydraulic fluid passages 30 with a drain passage 112 causing hydraulic fluid in the passages 30 to be at a relatively lower fluid pressure.

To begin fuel injection, an electronic signal from an electronic control module (not shown) causes the solenoid actuator 18 to be electrically energized thereby displacing the armature 22 upward and moving the poppet valve 20 to the second (upward) position. When the poppet valve 20 moves to the second position, the pressure of the fluid in the internal hydraulic fluid passages 30 rapidly increases due to communication with the inlet passage 28. The pressure of the hydraulic actuating fluid acts against the intensifier piston 26, forcing it and the plunger 34 downward against the spring 40.

A low pressure fuel transfer pump (not shown) supplies fuel to the inlet openings 102 of the injector 10 through a fuel rail or manifold preferably defined in a cylinder head (not shown) of an engine (not shown). Low pressure fuel enters the annular fuel passage 104 through the inlet openings 102, surrounding the barrel assembly 32 and the stop 44. Fuel passes from the annular passage 104, through the edge filter passage 106, past the first check valve 46, and into the fuel pumping chamber 38. Low pressure fuel passes from the pumping chamber 38, through the second check valve 48, through the fuel injection passages 54 and 62 of the sleeve and guide washer respectively, and to the injection chamber 76 of the blind bore 66.

The hydraulic pressure acting against the intensifier piston 26 generates a force acting on the fuel within the pumping chamber 38. That force is equal to the force on the intensifier piston 26 less that of the spring 40. As the spring 40 is preferably of relatively low load characteristics, the force against the fuel in the pumping chamber 38 will nearly equal the force against the intensifier piston 26 applied by the hydraulic actuating fluid. The fuel in the fuel pumping chamber 38 is therefore pressurized to a level approximately equal to the pressure of the hydraulic actuating fluid times the effective cross-sectional area of the intensifier piston 26 divided by the effective cross-sectional area of the plunger 34. An exemplary ratio of areas is approximately 7, resulting in a fuel pressure of approximately 161 MPa (23,350 psi) when the hydraulic pressure is about 23 MPa (3335 psi). The highly pressurized fuel in the pumping chamber 38 is in fluid communication with the fuel in the fuel injection passages 54, 62, causing fuel in the injection chamber 76 to be pressurized very rapidly. The rapidly pressurizing fuel in the injection chamber 76 acts against the seated needle check 84 on an area equal to a cross-section of the guide portion 88 minus a seating area defined by the engagement between the seat portion 86 of the check 84 and bottom portion 69 of the bore 66. The resultant force against the check 84 causes it to move upward, overcoming the spring 96. When the check 84 lifts away from the end portion 68 of the tip 64, the fuel begins to pass through the injection orifices 70 and is sprayed into the engine combustion chamber (not shown). The preselected pressure at which the check 84 first lifts is known as the valve opening pressure (VOP). Fuel discharge begins when the VOP is reached. Optimally for the fuel injector illustrated, the fuel injector 10 has a relatively low VOP to unseat the check 84, followed by a gradually rising rate of volumetric flow through the injection orifices 70 and followed by a sharp drop in volumetric flow rate to the end of injection.

Multi-stage rate shaping, in which the volumetric fuel flow rate into the combustion chamber is varied in a step like fashion, is employed in this invention. In the embodiment of FIG. 2, the check 84 restricts fuel flow through the fuel injection passage 62, initially limiting the pressure of fuel in the injection chamber 76 and the rate of fuel flow into the combustion chamber. Gradually increasing fuel pressure displaces the check 84 to reduce the restriction and increase the rate of fuel flow.

The initial flow of fuel to the injection chamber 76 is principally through the restrictive passage 72. This flow through the restrictive passage 72 slows the volumetric rate of fuel flow reaching the injection chamber 76, hence slowing the rate at which the check 84 is displaced upward, in turn slowing the volumetric rate of flow through the fuel injection spray orifices 70. It is anticipated that some amount of fuel will also enter the injection chamber 76 by passing through the annular clearance between the guide passage 60 and the guide portion 88 of the check 84 where they overlap between the fuel injection passage 62 and the cardioid section 74. With fuel flow into the injection chamber 76 being so restricted, the pressure therein is initially significantly less than the pressure in the fuel injection passage 62. Pressure gradually builds in the injection chamber 76 until the VOP is reached. Displacement of the check 84 to a height above L2 opens the injection chamber 76 to direct communication with the fuel injection passage 62, producing a sudden increase in pressure in the injection chamber 76 and flow thereto, rapidly displacing the check 84 to a distance of L1, the maximum available check displacement.

In an alternative embodiment without the restrictive passage 72, the guide portion 88 and guide passage 60 can be configured to provide a suitably restrictive path or passage between the fuel injection passage 62 and the injection chamber 76.

Forcing the fuel to initially pass through the restrictive passage 72 provides a slower entry of fuel into an engine combustion chamber, allowing an early start of combustion flame with longer duration thereby reducing engine combustion noise and NOX emissions, and allowing timing advances to minimize particulate emissions. The desired rate shaping is obtained without the need for any special guide bores or guide passages near the tip 68 of the nozzle 12. This greatly facilitates the manufacture of the nozzle 12.

To end fuel injection, the electronic signal from the electronic control module is discontinued causing the solenoid actuator 18 to be electronically deenergized. A return spring 114 then moves the poppet valve 20 and armature 22 to the first position thereby blocking the inlet passage 28 and opening fluid communication between the passages 30 and the drain passage 112. When the fluid pressure in passages 30 drops sufficiently, the return spring 40 axially displaces the plunger 34 and the intensifier piston 26 upwardly according to FIG. 1 thereby increasing the volume of the fuel pumping chamber 38. When the high pressure of fuel in the pumping chamber 38 has been sufficiently lowered, and the fuel pressure within the injection chamber 76 sufficiently drops, the spring 96 acts to quickly return the check 84 to the first position, providing the desired rapid termination of volumetric flow through the injection orifices 70.

Figure 5A:
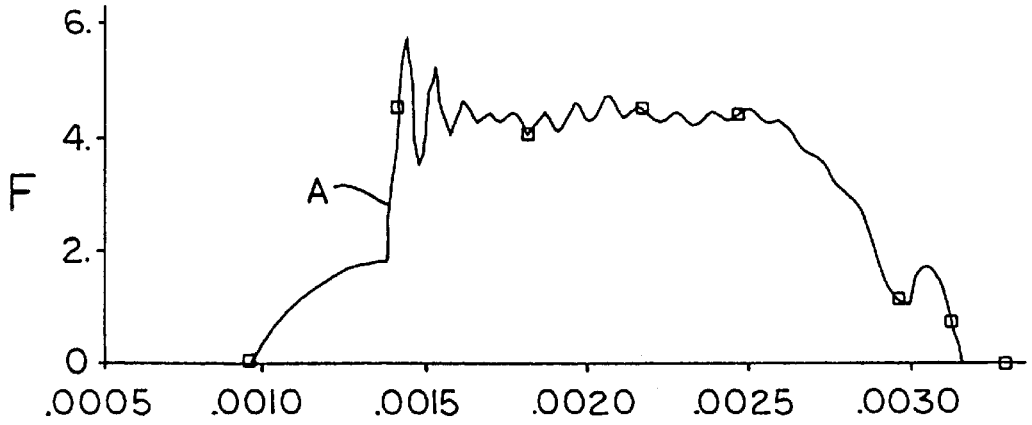
FIG. 5A is an exemplary plot of injection rate F.
Figure 5B:
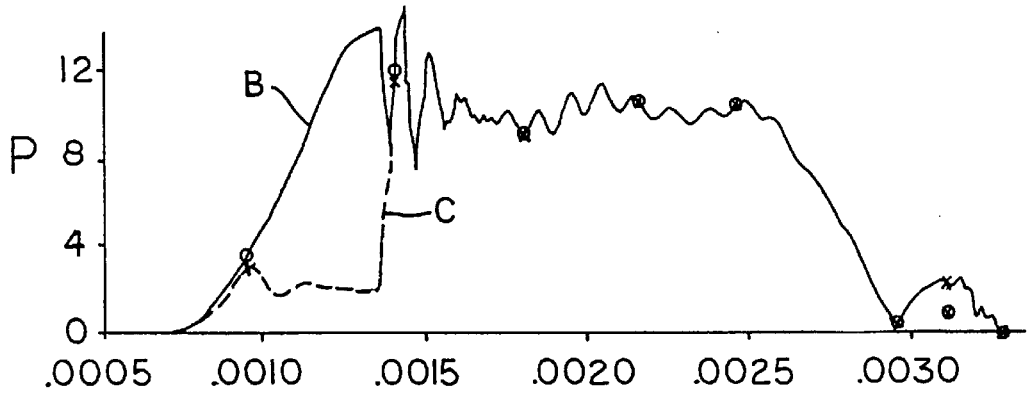
FIG. 5B is an exemplary plot of pressure P.
Figure 5C:
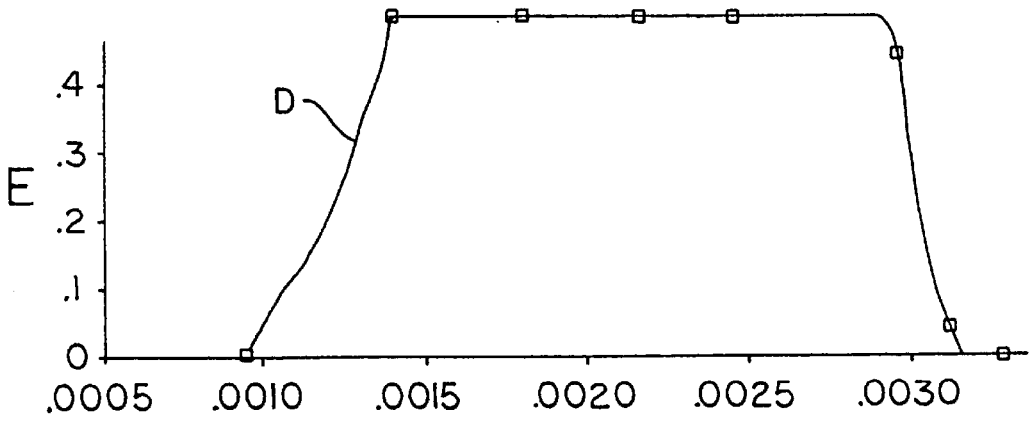
FIG. 5C is an exemplary plot of the displacement E as a function of time t.

The volumetric flow rate of fuel through the injector orifices 70 is a function in part of both orifice geometry and the distance of the check seat portion 86 from the bottom of the bore 66, as this distance serves to restrict fuel from reaching the orifices 70. The greater the lift height of the check 84, the greater the clearance between the seat portion 86 of the check 84 and the end portion 68 of the tip 64, the greater the volumetric rate of flow through the orifices 70 will be. FIGS. 5A, 5B and 5C show characteristic plots of the present invention. Plot A of FIG. 5A shows injection flow rate, F, in liters per minute of fuel flowing from the orifices 70 as a function of time, t, in seconds. Plot B of FIG. 5B shows a guide annulus pressure, P, in units of MPa as a function of time, t, in seconds. Plot C, also of FIG. 5B shows a guide pressure, P, in units of MPa as a function of time, t, in seconds. Plot D of FIG. 5C shows check 84 displacement, E, in units of millimeters (mm) as a function of time, t, measured in seconds, for the present invention.

It should be appreciated that although this invention is described in the context of a HEUI unit fuel injector, it is equally applicable to nonunitized HEUI fuel injectors as well as mechanically actuated fuel injectors. This invention is well suited for use with any high pressure fuel injector employing a guided check 84.

Other aspects, objects and advantages of this invention can be obtained from a study of the drawings, the disclosure and the appended claims.

What is claimed is:

1. A fuel injector nozzle comprising:

a nozzle housing including a nozzle spray tip defining a blind bore along a longitudinal axis with at least one orifice defined through an end portion of the tip also defining a bottom portion of the bore and a guide passage at a top portion of the bore and an injection chamber between the bottom portion of the bore and the guide passage and the housing also defining a fuel injection passage intersecting the guide passage, the nozzle housing including a guide washer disposed over a top of the nozzle spray tip providing an extension of the guide passage and there being a groove in one of the nozzle spray tip and the guide washer serving as a portion of the fuel injection passage intersecting the guide passage;

a needle check slidably disposed in the blind bore for slidable axial displacement therein between a first position in which a seat portion thereof is disposed against the end portion of the tip and in which a guide portion thereof with a portion of the guide passage below the fuel injection passage defines a first flow area restrictive of fluid flow therethrough and also defines a second position in which the seat portion is spaced from the end portion of the tip and the guide portion with the guide passage below the fuel injection passage defines a second flow area larger than the first flow area and less restrictive of flow therepast.

2. A fuel injector nozzle comprising:

a nozzle housing including a nozzle spray tip defining a blind bore along a longitudinal axis with at least one orifice defined through an end portion of the tip also defining a bottom portion of the bore and a guide passage at a top portion of the bore and an injection chamber between the bottom portion of the bore and the guide passage and the housing also defining a fuel injection passage intersecting the guide passage and having a restrictive passage through the housing with a flow area less than the second flow area fluidly connects the fuel injection passage with the injection chamber;

a needle check slidably disposed in the blind bore for slidable axial displacement therein between a first position in which a seat portion thereof is disposed against the end portion of the tip and in which a guide portion thereof with a portion of the guide passage below the fuel injection passage defines a first flow area restrictive of fluid flow therethrough and also defines a second position in which the seat portion is spaced from the end portion of the tip and the guide portion with the guide passage below the fuel injection passage defines a second flow area larger than the first flow area and less restrictive of flow therepast.

3. The fuel injector nozzle providing multi-stage rate shaping comprising:

a nozzle spray tip defining a blind bore therein with at least one fuel spray orifice defined through a bottom portion of the tip and a guide passage defined at a top portion of the bore;

a guide washer disposed over a top of the nozzle spray tip defining an extension of the guide passage of the nozzle spray tip and also defining a fuel injection passage through the guide washer from a top of the guide washer opposite the nozzle spray tip to the extension of the guide passage at the guide washer adjacent the nozzle spray tip;

a check slidably disposed in the bore and in a first position disposed against the end portion of the tip blocking fluid communication with the orifice and defining with the guide passage a first flow area restrictive of fluid flow therethrough and in a second position spaced from the end portion of the tip defining with the guide passage a second flow area larger than the first flow area and less restrictive of flow therepast.

4. The fuel injector nozzle as claimed in claim 3 wherein a restrictive passage in the nozzle spray tip is open at the top portion of the nozzle spray tip to the fuel injection passage of the guide washer and passes through the nozzle spray tip to the blind bore below the guide passage for communicating fluid from the fuel injection passage to the blind bore.

* * * * *